US005086793A

United States Patent [19]

Kingsford

[11] Patent Number: 5,086,793

[45] Date of Patent: Feb. 11, 1992

[54] ADJUSTABLE MASCARA APPLICATOR

[75] Inventor: Ted I. Kingsford, Sarasota, Fla.

[73] Assignee: Maybe Holding Co., Wilmington, Del.

[21] Appl. No.: 611,649

[22] Filed: Nov. 13, 1990

[51] Int. Cl.[5] ..... A45D 40/26

[52] U.S. Cl. ..... 132/218; 132/216; 401/127

[58] Field of Search ..... 132/129, 130, 136, 216, 132/218, 219, 320; 401/127, 129

[56] References Cited

U.S. PATENT DOCUMENTS

| | | | |
|---|---|---|---|
| 2,007,245 | 7/1935 | Gimonet | 132/218 |
| 3,998,235 | 12/1976 | Kingsford | 132/218 |
| 4,446,880 | 5/1984 | Gueret et al. | 132/218 |
| 4,498,490 | 2/1985 | Seidler | 132/218 |
| 4,545,393 | 10/1985 | Gueret et al. | 132/218 |

*Primary Examiner*—John J. Wilson
*Assistant Examiner*—Jeffrey A. Smith

[57] ABSTRACT

An adjustable mascara applicator includes a comb formed by a first comb section having a first proximal end, a first distal end, and a first set of teeth at the first distal end, the proximal end including opposing side walls having teeth thereon, and a second comb section having a second proximal end, a second distal end and a second set of teeth at the second distal end, the first and second comb sections each extending in a longitudinal direction between the proximal and distal ends thereof for holding mascara therebetween; a cylindrical handle fixedly connected with the proximal end of the second comb section and including an elongated slot for receiving the proximal end of the first comb section therethrough, the handle being used for grasping the adjustable mascara applicator during use; an adjustment knob rotatably connected with the handle and extending partially therein for receiving the proximal end of the second comb section, the adjustment knob including an internal helical thread for meshingly engaging with the teeth at the proximal end of the first comb section so as to move the first comb section in the longitudinal direction with respect to the second comb section upon rotation of the adjustment knob, so as to vary the spacing between adjacent teeth; and a mascara container removably connected with the cylindrical handle, the container including an opening for receiving the distal ends of the first and second comb sections, and a wiper for wiping excess mascara from the teeth during withdrawal thereof from the container.

36 Claims, 4 Drawing Sheets

ADJUSTABLE MASCARA APPLICATOR

BACKGROUND OF THE INVENTION

This invention relates generally to mascara applicators, and more particularly, is directed to a variable tooth mascara comb.

Mascara applicators are well-known in the art. Conventionally, masdara applicators include a shaft having a brush formed by tufts or bristles at one end thereof. The bristles have a fixed relation to each other, and accordingly, the quantity of mascara retained on the bristles remains constant at all times. During non-use thereof, the applicator is positioned within a container which holds a mass of mascara. Upon removal of the applicator from the container, excess mascara on the brush is removed by an elastic wiper as the applicator is withdrawn from the container. Therefore, a metered or fixed amount of mascara remains on and between the bristles. This, however, is disadvantageous since the length, thickness, density and shape of eyelashes will vary considerably from person to person. Further, it may be desirable to apply different amounts of mascara on the upper and lower eyelashes, and this cannot be accomplished with a fixed amount of mascara on the brush.

Although other types of applicators are known, such as those including a plurality of comb teeth, as disclosed in U.S. Pat. No. 3,892,248 to Kingsford, the same problems result.

In this regard, it is known to provide mascara applicators of an adjustable nature. For example, U.S. Pat. No. 3,998,235 to Kingsford discloses an adjustable mascara applicator having a helical spring held on the distal end of the applicator shaft. The helical spring can be expanded and contracted to vary the spacing between the coils for holding different amounts of mascara.

U.S. Pat. Nos. 4,446,880 and 4,545,393, both to Gueret et al, disclose mascara applicators having a tubular member with teeth along the outer periphery thereof. The tubular member is positioned around the end of the applicator shaft and is compressible so as to vary the spacing between the teeth. In one embodiment, the teeth are formed by a bellows-type arrangement. In this regard, these devices are similar to that of U.S. Pat. No. 3,998,235 to Kingsford in that variable tooth spacing is achieved by compression or expansion of the tubular member.

OBJECTS AND SUMMARY OF THE INVENTION

Accordingly, it is an object of the present invention to provide an adjustable mascara applicator that overcomes the aforementioned problems with the prior art.

It is another object of the present invention to provide an adjustable mascara applicator in which the spacing between adjacent teeth can be varied for holding different amounts of mascara.

It is still another object of the present invention to provide an adjustable mascara applicator formed by two adjacent comb sections, at least which one of is slidable relative to the other.

It is yet another object of the present invention to provide an adjustable mascara applicator having teeth of differing or the same height.

It is a further object of the present invention to provide an adjustable mascara applicator that is relatively economical and easy to manufacture and use.

In accordance with an aspect of the present invention, an adjustable mascara applicator includes comb means having a proximal end, a distal end and a plurality of teeth at the distal end for holding mascara therebetween, the comb means extending in a longitudinal direction between the proximal end and the distal end; handle means connected with the comb means for grasping the adjustable mascara applicator during use; adjustment means for sliding some of the teeth in a longitudinal direction relative to the remaining teeth, so as to vary the spacing between adjacent ones of the teeth in the longitudinal direction; and mascara container means for containing mascara, the container means including an opening for receiving the distal end of the comb means.

In accordance with another aspect of the present invention, an adjustable mascara applicator includes comb means formed by a first comb section having a first proximal end, a first distal end and a first set of teeth at the first distal end, and a second comb section having a second proximal end, a second distal end and a second set of teeth at the second distal end, the first and second comb sections each extending in a longitudinal direction between the proximal and distal ends thereof for holding mascara therebetween; handle means connected with the comb means for grasping the adjustable mascara applicator during use; adjustment means for moving at least one of the first and second comb sections with respect to the other of the first and second comb sections in the longitudinal direction, so as to vary the spacing between adjacent ones of the teeth of the first and second comb sections in the longitudinal direction; and mascara container means for containing mascara, the container means including an opening for receiving the distal ends of the first and second comb sections, and wiper means for wiping excess mascara from the teeth during withdrawal thereof from the container means.

The above and other objects, features and advantages of the present invention will become readily apparent from the following detailed description thereof which is to be read in connection with the accompanying drawings.

DETAILED DESCRIPTION OF A PREFERRED EMBODIMENT

Figure 1:
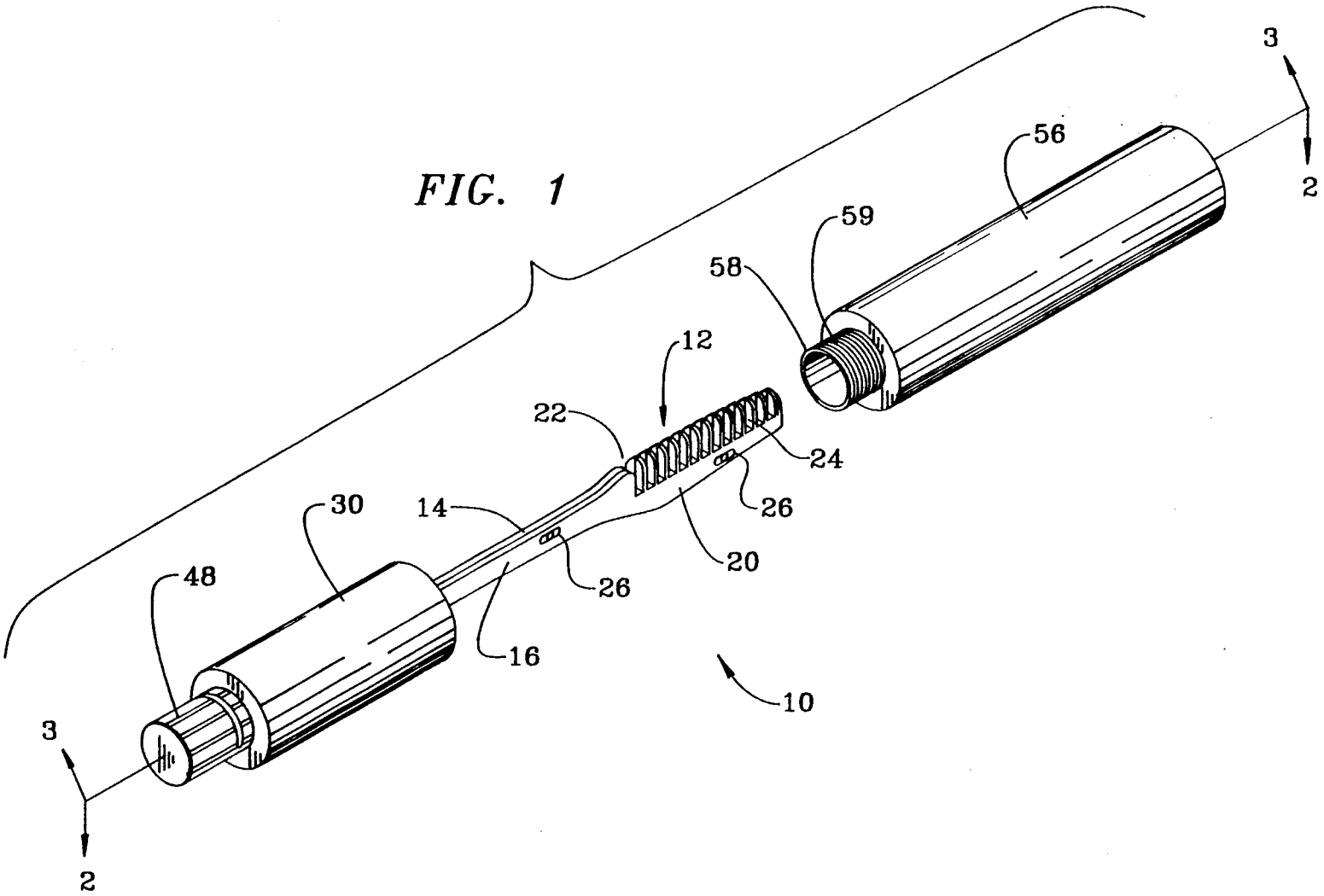
FIG. 1 is a perspective view of an adjustable mascara applicator according to the present invention.

Referring to the drawings in detail, an adjustable mascara applicator 10 according to the present invention includes a comb 12 formed by first and second comb sections 14 and 1 6. Each comb section 14 and 16 includes a proximal end 18 and an opposite distal end 20. First comb section 14 includes a plurality of equidistantly spaced teeth 22 at distal end 20 thereof and, in like manner, second comb section 1 6 includes a plurality of equidistantly spaced teeth 24 at distal end 20 thereof. First and second comb sections 14 and 16 are positioned flush against each other such that teeth 22 and 24 are adjacent each other.

As shown best in FIGS. 3–6, the height of teeth 22 and 24 decrease toward the distal ends 20 of comb sections 14 and 16, respectively. However, it will be appreciated that teeth 22 and 24 can all be of the same height, as shown in FIG. 7. It will be appreciated that teeth of the same height provide the advantage of facilitating wiping of the mascara from the teeth when exiting the mascara container so as to achieve a cleaner wipe of the shafts of comb sections 14 and 16, and the areas surrounding the teeth, so that the only remaining mascara will be between the teeth.

Figure 5:
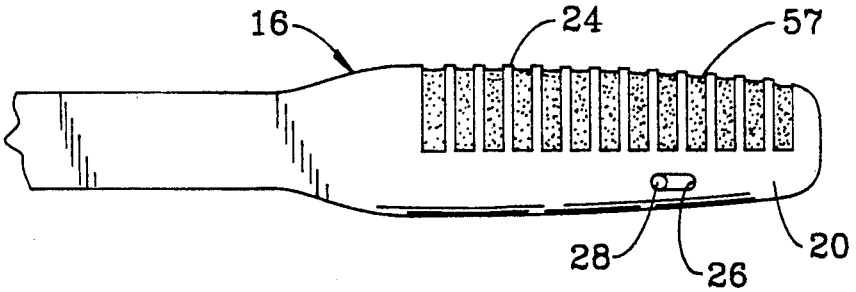
FIG. 5 is a side elevational view of the distal end portion of the adjustable mascara applicator of FIG. 1, with maximum spacing between the teeth.
Figure 6:
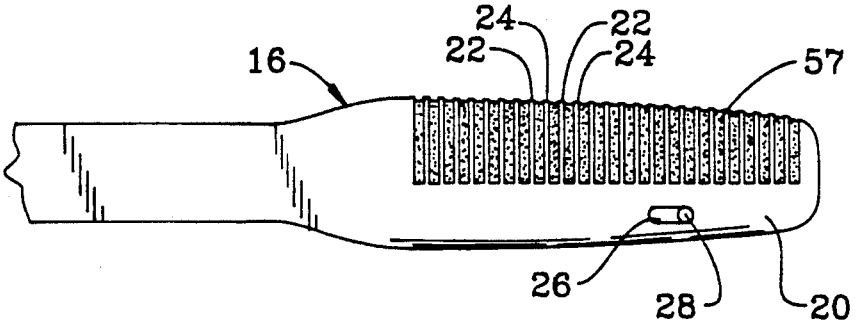
FIG. 6 is a side elevational view of the distal end portion of the adjustable mascara applicator of FIG. 1, with a reduced spacing between the teeth.
Figure 7:
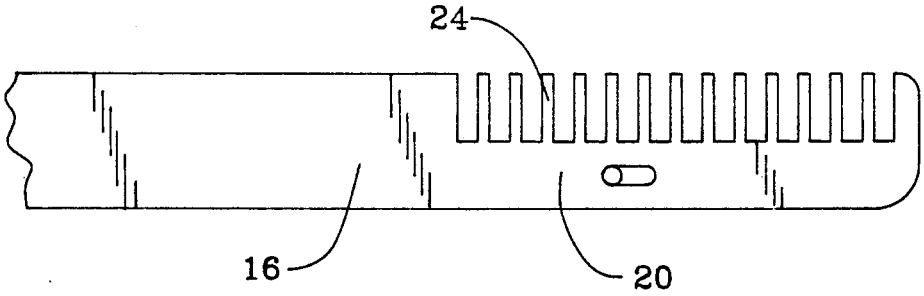
FIG. 7 is a side elevational view of the distal end portion of an adjustable mascara applicator according to another embodiment of the present invention.

With the aforementioned arrangement, as shown best in FIGS. 5 and 6, when teeth 22 and 24 are in alignment with each other, the spacing between adjacent teeth in the longitudinal direction of applicator 10 is at a maximum. On the other hand, when first and second comb sections 14 and 16 are slid with respect to each other in the longitudinal direction of applicator 10, as shown in FIG. 6, the spacing between adjacent teeth 22 and 24 is reduced. As a result, the amount of mascara that can be applied to the eyelashes can be varied. At the same time, the smaller spacing between the teeth in FIG. 6 provides for better separation of the eyelashes after an initial application of mascara, as will be described in greater detail hereinafter.

In order to guide first and second comb sections 14 and 16 with respect to each other during such sliding movement, second comb section 16 is provided with two spaced longitudinally extending slots 26, one slot being substantially midway therealong and the other slot being positioned immediately below teeth 24. In correspondence thereto, first comb section 14 has two integrally formed pins 28 extending within slots 26 so as to guide the sliding movement of first and second comb sections 14 and 16, and to also limit the amount of such sliding movement.

It will be appreciated that other guide arrangements can be provided. For example, stops can be incorporated into applicator 10. Alternatively, comb sections 14 and 16 can be molded with tongue and groove configurations to lock sections 14 and 16 together, while still permitting relative sliding movement therebetween.

Figure 2:
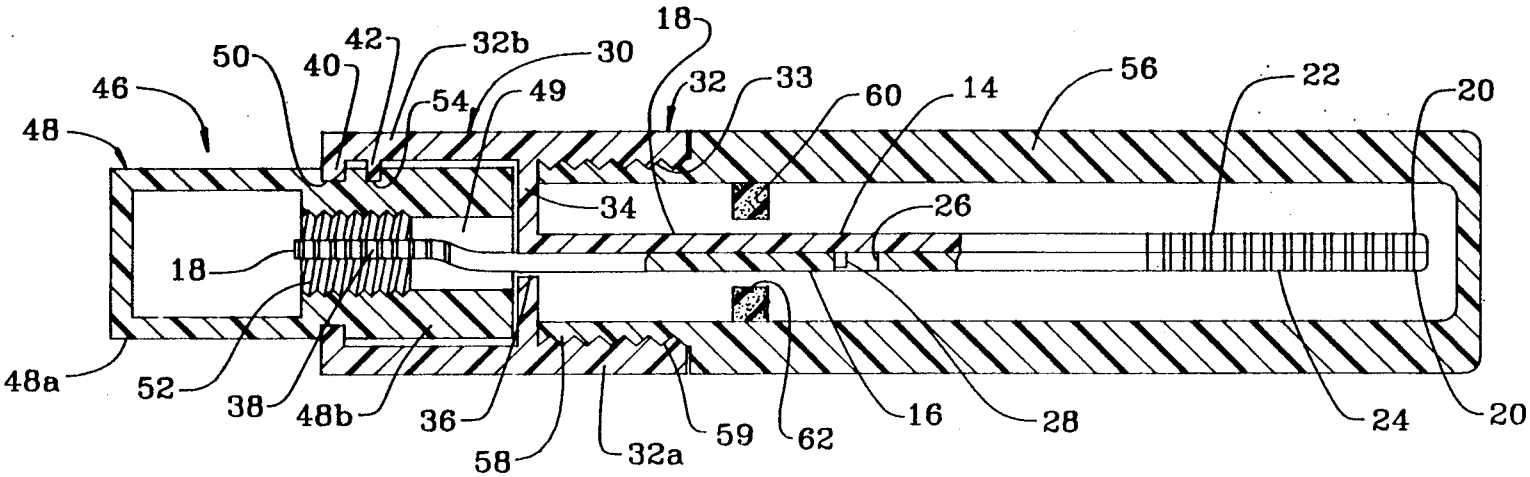
FIG. 2 is a cross-sectional view of the adjustable mascara applicator of FIG. 1 in assembled condition, taken along line 2—2 thereof.
Figure 3:
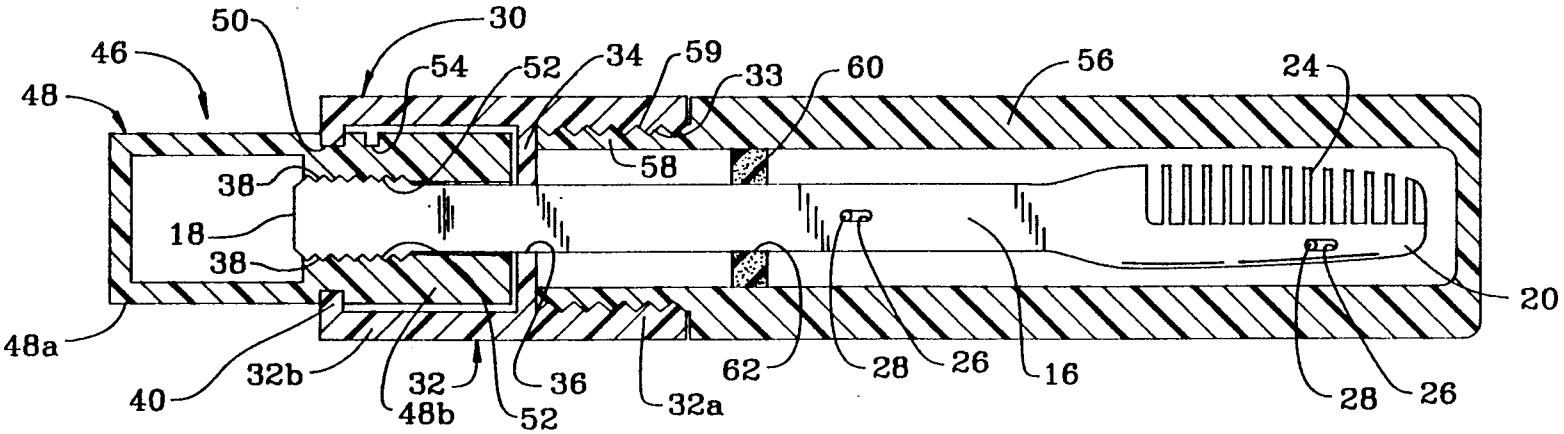
FIG. 3 is a cross-sectional view of the adjustable mascara applicator of FIG. 1 in assembled condition, taken along line 3—3 thereof.

As shown best in FIGS. 1–3, adjustable mascara applicator 10 further includes a handle 30 connected with comb 12 for grasping adjustable mascara applicator 10 during use. Specifically, handle 30 includes a cylindrical body 32 which a person grasps during use of adjustable mascara applicator 10. A disc-like inner wall 34, lying in a plane substantially transverse to the longitudinal axis of cylindrical body 32, is integrally formed with cylindrical body 32, so as to substantially divide cylindrical body 32 into a cylindrical container securing section **32*a* having internal threads 33 and a cylindrical adjustment section 32*b***.

Figure 4:
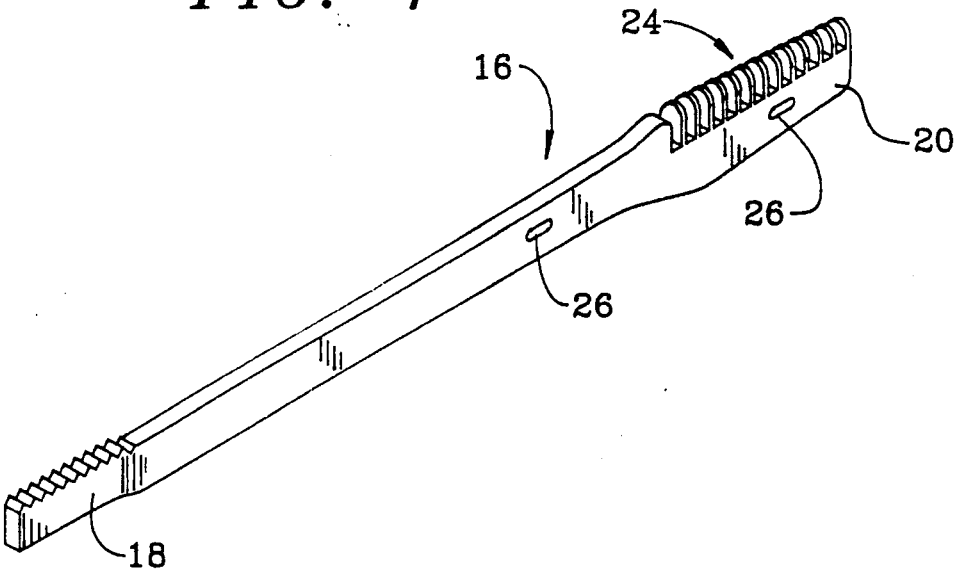
FIG. 4 is a perspective view of one comb section of the adjustable mascara applicator of FIG. 1.

Proximal end 18 of first comb section 14 extends within container securing section **32*a* and is integrally formed with inner wall 34, slightly offset from the center thereof. Immediately adjacent to such connection, inner wall 34 is provided with an elongated slot 36 through which proximal end 18 of second comb section 16 extends. As shown in FIGS. 2 and 3, when teeth 22 and 24 of first and second comb sections 14 and 16 are in alignment, the proximal end 18 of second comb section 16 extends past the proximal end 18 of first comb section 14, through slot 36 and within adjustment section 32*b* of cylindrical body 32. As also shown in FIGS. 2–4, proximal end 18 of second comb section 16 is bent so as to be substantially centrally aligned within adjustment section 32*b*. Further, as will be discussed hereinafter, the opposite side edges of proximal end 18 of second comb section 16, are provided with teeth 38** therealong.

As also shown in FIGS. 2 and 3, proximal end 18 of adjustment section **32*b* of cylindrical body 32 includes a slightly inturned circumferential flange 40, and a stop pin 42 extending radially inward from the inner wall of adjustment section 32*b* at a position substantially one-fourth of the way between inturned circumferential flange 40 and inner wall 34**.

Adjustable mascara applicator 10 further includes an adjustment device 46 for moving second comb section 16 in a lengthwise direction thereof with respect to first comb section 14 so as to vary the spacing between adjacent teeth 22 and 24, in the manner shown in FIGS. 5 and 6.

Specifically, adjustment device 46 includes an adjustment knob 48 which fits partially within adjustment section **32*b* of cylindrical body 32. Adjustment knob 48 includes a circumferential groove 50 substantially midway therealong, which receives inturned circumferential flange 40 of cylindrical body 32 so as to rotatably secure adjustment knob 48 to cylindrical body 32. Groove 50 effectively divides adjustment knob 48 into a grasping section 48*a* which extends outwardly from cylindrical body 32 and which can be rotated by a person, and an adjusting section 48*b* integrally formed with grasping section 48*a* and extending within adjustment section 32*b* of cylindrical body 32. Adjusting section 48*b* is hollow such that the cylindrical inner wall thereof defines a chamber 49 for receiving the proximal end 18 of comb section 16. Chamber 49 has a diameter approximately equal to that of proximal end 18 of second comb section 16 and includes an internal helical thread 52 at the internal wall thereof, which meshingly engages with teeth 38 of second comb section 16. As a result, rotation of knob 48 causes movement of second comb section 16 in the lengthwise direction thereof, the direction of movement of second comb section 16 depending upon the direction of rotation of knob 48. As a result, the spacing between teeth 22 and 24 can be varied by the user by rotation of adjustment knob 48**.

It will be appreciated that rotation of knob 48, and thereby differential movement of second comb section 16 with respect to first comb section 14, is limited by pins 28 within slots 26. As a further limitation on such movement, adjusting section 48*b* is preferably provided with a groove 54 extending partially thereabout in the circumferential direction, groove 54 receiving stop pin 42. Accordingly, abutment of stop pin 42 against the end walls of groove 54 will further limit rotation of knob 48 to provide an additional safeguard from over-rotation thereof.

Adjustable mascara applicator 10 further includes a mascara container 56 which contains a supply of mascara 57. Mascara container 56 includes a reduced diameter neck 58 which is open to receive comb 12, neck 58 having external threads 59 thereon for threaded engagement with threads 33 of cylindrical body 32, so as to releasably secure cylindrical body 32 to mascara container 56. In such case, comb 12 extends within mascara container 56.

In the position shown in FIGS. 2 and 3, teeth 22 and 24 are thereby covered completely with mascara. In order to wipe excess mascara from comb 12, an elastic, resilient wiper 60 is secured to the inner wall of mascara container 56 and has a central slotted, slit-like or rectangular opening 62 to conform to the cross-section of comb 12 so as to permit entry and exit of comb 12 from mascara container 56. It will be appreciated, however, that the dimensions of opening 62 are slightly smaller than that of comb 12 so as to provide a wiping action against teeth 22 and 24 in order to remove excess mascara during removal of comb 12 from mascara container 56.

In one mode of operation, teeth 22 and 24 are in alignment within mascara container 56. Upon removal thereof, a wiping action is performed by wiper 60, and comb 12 is used to apply mascara to the eyelashes. It will be appreciated that, in such condition, a maximum amount of mascara 57 is applied, as shown in FIG. 5, with wide spacing between teeth 22 and 24. In order to provide better separation of the lashes after an initial application of mascara, adjustment knob 48 is rotated to reduce the spacing between teeth 22 and 24, as shown in FIG. 6, and comb 12 is run through the eyelashes to remove excess mascara and provide better separation between the lashes.

In an alternative mode of operation, teeth 22 and 24 can be arranged as shown in FIG. 6 when positioned in mascara container 56. Upon use thereof, comb 12 is removed from mascara container 56 and a wiping action is performed by wiper 60. Thereupon, the mascara 57 between teeth 22 and 24, as shown in FIG. 6, is applied to the eyelashes, providing better separation and application of the mascara in a one-step process.

Figure 8:
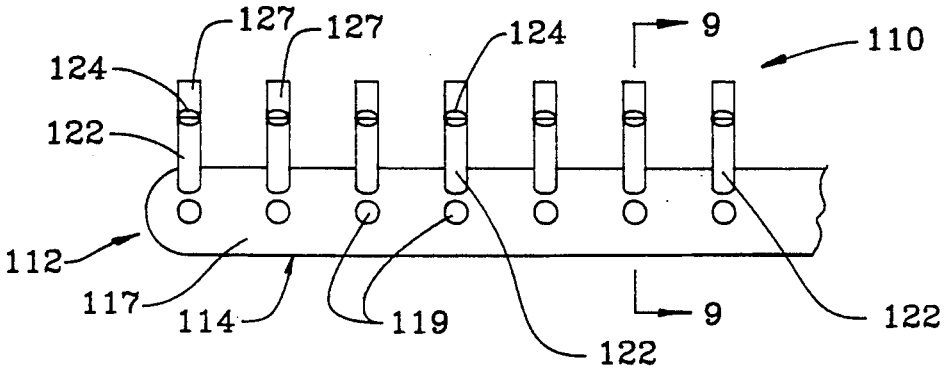
FIG. 8 is a side elevational view of an adjustable mascara applicator according to still another embodiment of the present invention, with maximum spacing between the teeth.
Figure 9:
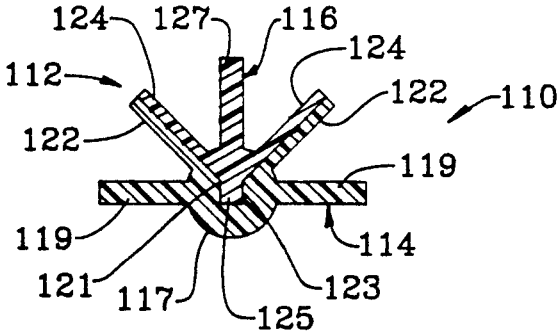
FIG. 9 is a cross-sectional view of the adjustable mascara applicator of FIG. 8, taken along line 9—9 thereof.
Figure 10:
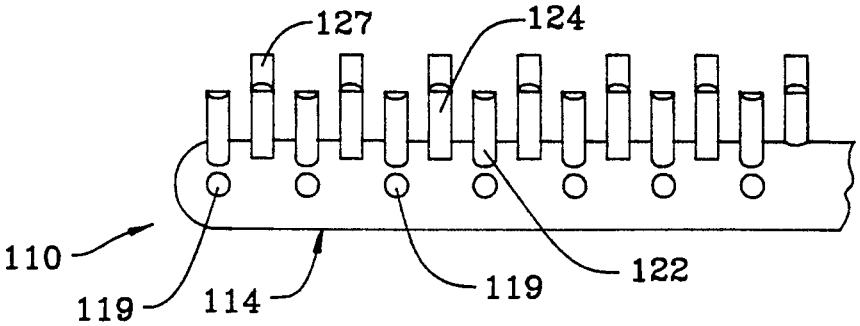
FIG. 10 is a side elevational view of the distal of the adjustable mascara applicator of FIG. 8, with minimum spacing between the teeth.

Referring now to FIGS. 8–10, an adjustable mascara applicator 110 according to another embodiment of the present invention will now be described in which elements corresponding to those described above with respect to adjustable mascara applicator 10 are identified by the said reference numerals augmented by 100, and a detailed description of the common elements will be omitted herein for the sake of brevity.

Specifically, comb section 114 is formed with a cylindrical hub 117 which is fixed to the handle (not shown). A plurality of diametrically opposite side teeth 119 are integrally formed in spaced relation along opposite sides of hub 117. The spacing between adjacent teeth 119 on the same side represents the maximum spacing between the teeth of comb 112. A plurality of half-teeth 122 also extend from opposite sides of hub 117 in alignment with teeth 119 and extending at an angle of approximately 30 degrees with teeth 119 on each side of hub 117. Accordingly, an angle of approximately 120 degrees is provided between half-teeth 122 on opposite sides of hub 117. It will be appreciated, however, that the angles given herein are only of an exemplary embodiment and that other suitable angles may be utilized.

The upper portion of hub 117 between teeth 122 is provided with a V-shaped notch forming a continuation of the inner surfaces of half-teeth 122 and terminating in a radial groove 123 extending the length of hub 117. In effect, V-shaped notch 121 and groove 123 form a substantially Y-shaped configuration.

Comb section 116 is provided with an elongated protrusion 125 extending from the lower portion thereof and which is dimensioned to slidably fit within groove 123 for movement therealong. A plurality of teeth 127 extend along protrusion 125 with the same pitch as teeth 119. Teeth 127 effectively bisect the angle between diametrically opposite teeth 119. In addition, a plurality of half-teeth 124 are provided, extending from opposite sides of protrusion 125 at the same angle as half-teeth 122 and slidable thereon. Half-teeth 122 and 124 form full cylindrical teeth when in alignment, as shown in FIG. 8, corresponding to the maximum spacing between such teeth. The proximal end (not shown) of comb section 116 can be provided with an arrangement similar to that of mascara applicator 10 of FIG. 1 for movement of comb section 116 along comb section 114.

Thus, as with mascara applicator 10, rotation of knob 48 will result in comb section 116 moving in the longitudinal direction along comb section 114 so as to vary the spacing between half-teeth 122 and 124 from the maximum spacing shown in FIG. 8 to the minimum spacing shown in FIG. 10.

It will be appreciated that there are numerous other arrangements that can be utilized with the present invention and that the key to the present invention is the movement of one comb section relative to another comb section to provide variable spacing between the teeth of the mascara applicator. For example, it is possible that the teeth can be provided in a full circular configuration about hub 117, rather than the half-circular configuration of FIG. 9.

Having described a specific preferred embodiment of the invention with reference to the accompanying drawings, it will be appreciated that the present invention is not limited to that precise embodiment, and that various changes and modifications can be effected therein by one of ordinary skill in the art without departing from the spirit or scope of the invention as defined by the appended claims.

What is claimed is:

1. An adjustable mascara applicator comprising:

comb means for applying mascara to eyelashes, said comb means having a proximal end, a distal end and a plurality of teeth at said distal end for holding mascara therebetween, said comb means extending in a longitudinal direction between said proximal end and said distal end, said teeth being arranged in at least one row along the longitudinal axis of said comb means;

handle means connected with said comb means for grasping said adjustable mascara applicator during use;

adjustment means for moving some of said teeth in said longitudinal direction relative to the remaining teeth, so as to vary the spacing between adjacent ones of said teeth in said longitudinal direction; and mascara container means for containing mascara, said container means including an opening for receiving said distal end of said comb means.

2. An adjustable mascara applicator according to claim 1, wherein said container means includes wiper means from wiping excess mascara from said teeth during withdrawal thereof from said container means.

3. An adjustable mascara applicator comprising:

comb means for applying mascara to eyelashes, said comb means having a proximal end, a distal end and a plurality of teeth at said distal end for holding mascara therebetween, said comb means extending in a longitudinal direction between said proximal end and said distal end;

handle means connected with said comb means for grasping said adjustable mascara applicator during use;

adjustment means for moving some of said teeth in said longitudinal direction relative to the remaining teeth, so as to vary the spacing between adjacent ones of said teeth in said longitudinal direction; and mascara container means for containing mascara, said container means including an opening for receiving said distal end of said comb means, wherein said comb means includes a first comb section having a distal end and a first set of said teeth at said distal end and a second comb section having a distal end and a second set of said teeth at said distal end; and said adjustment means includes means for moving said first comb section with respect to said second comb section in said longitudinal direction.

4. An adjustable mascara applicator according to claim 3, wherein said second comb section is fixedly connected with sidehandle means.

5. An adjustable mascara applicator according to claim 4, wherein said adjustment means is secured to said handle means.

6. An adjustable mascara applicator according to claim 5, wherein said adjustment means is rotatably secured to said handle means.

7. An adjustable mascara applicator according to claim 6, wherein said handle means includes a body having a proximal end with an inturned flange and said adjustment means includes a knob positioned partially within said body and including a groove for receiving said flange so as to permit relative rotation between said knob of said adjustment means and said body of said handle means.

8. An adjustable mascara applicator according to claim 7, wherein said knob includes an inner wall defining a chamber for receiving the proximal end of said first comb section, said inner wall having a helical thread therealong; and said proximal end of said first comb section has teeth means for meshingly engaging with said helical thread.

9. An adjustable mascara applicator according to claim 8, wherein said body has an inner wall extending substantially transverse to said longitudinal direction, said inner wall separating said body into a container securing section and an adjustment section, and said inner wall including an opening therein for receiving said proximal end of said first comb section into said adjustment section and within said chamber.

10. An adjustable mascara applicator according to claim 9, wherein said second comb section is fixedly connected 11. An adjustable mascara applicator according to claim 3, wherein said body has an inner wall extending substantially transverse to said longitudinal direction, said inner wall separating said body into a container securing section and an adjustment section, and said inner wall including an opening therein for receiving said proximal end of said first comb section into said adjustment section.

12. An adjustable mascara applicator according to claim 11, wherein said second comb section is fixedly connected to said inner wall.

13. An adjustable mascara applicator according to claim 7, wherein said handle means includes a stop and said knob includes a groove for receiving said stop so as to limit rotational movement of said knob with respect to said handle means.

14. An adjustable mascara applicator according to claim 3, wherein said first comb section includes at least one slot therein extending in said longitudinal direction thereof and said second comb means includes at least one pin positioned within said at least one slot for limiting movement of said first comb section with respect to said second comb section in said longitudinal direction thereof.

15. An adjustable mascara applicator according to claim 3, wherein the teeth in each of said first and second sets of teeth decrease in height from said proximal end to said distal end of said first and second comb sections.

16. An adjustable mascara applicator according to claim 3, wherein said second comb section includes a central hub and said second set of teeth include a plurality of teeth extending substantially radially outward from opposite sides of said hub with a predetermined angular relation between said teeth on opposite sides of said hub, and said hub includes a longitudinal groove extending therealong; and said first comb section includes a projection slidably positioned for movement within said groove and said first set of teeth includes a plurality of teeth extending from opposite sides of said projection with said predetermined angular relation between teeth of said first set such that teeth of said first and second sets can be adjusted to provide a variable spacing therebetween.

17. An adjustable mascara applicator according to claim 16, wherein said teeth of said first and second sets are arranged in at least a part-circular arrangement.

18. An adjustable mascara applicator according to claim 17, wherein said predetermined angular relation is approximately 120 degrees.

19. An adjustable mascara applicator according to claim 16, wherein said second comb section includes diametrically opposite additional teeth with a predetermined pitch therebetween extending from said hub and said teeth of said first set extend from said hub at an angle to said diametrically opposite additional teeth so as to form a V-shape therebetween.

20. An adjustable mascara applicator comprising:

comb means for applying mascara to eyelashes, said comb means formed by a first comb section having a first proximal end, a first distal end and a first set of teeth at said first distal end, and a second comb section having a second proximal end, a second distal end and a second set of teeth at said second distal end, said first and second comb sections each extending in a longitudinal direction between said proximal and distal ends thereof for holding mascara therebetween;

handle means connected with said comb means for grasping said adjustable mascara applicator during use;

adjustment means for moving at least one of said first and second comb sections with respect to the other of said first and second comb sections in said longitudinal direction, so as to vary the spacing between adjacent ones of said teeth of said first and second comb sections in said longitudinal direction; and mascara container means for containing mascara, said container means including an opening for receiving said distal ends of said first and second comb sections, and wiper means for wiping excess mascara from said teeth during withdrawal thereof from said container means.

21. An adjustable mascara applicator according to claim 20, wherein said second comb section is fixedly connected with said handle means, and said adjustment means includes means for moving said first comb section in said longitudinal direction with respect to said second comb section.

22. An adjustable mascara applicator according to claim 21, wherein said adjustment means is secured to said handle means.

23. An adjustable mascara applicator according to claim 22, wherein said adjustment means is rotatably secured to said handle means.

24. An adjustable mascara applicator according to claim 23, wherein said handle means includes a cylindrical body having a proximal end with an inturned flange and said adjustment means includes a cylindrical knob positioned partially within said body and including a groove for receiving said flange so as to permit relative rotation between said cylindrical knob of said adjustment means and said cylindrical body of said handle means.

25. An adjustable mascara applicator according to claim 24, wherein said knob includes an inner wall defining a chamber for receiving the proximal end of said first comb section, said inner wall having a helical thread therealong; and said proximal end of said first comb section has teeth means for meshingly engaging with said helical thread.

26. An adjustable mascara applicator according to claim 25, wherein said body has an inner wall extending substantially transverse to said longitudinal direction, said inner wall separating said body into a container securing section and an adjustment section, and said inner wall including an opening therein for receiving said proximal end of said first comb section into said adjustment section and within said chamber.

27. An adjustable mascara applicator according to claim 26, wherein said second comb section is fixedly connected to said inner wall.

28. An adjustable mascara applicator according to claim 24, wherein said handle means includes a stop and said knob includes a groove for receiving said stop so as to limit rotational movement of said knob with respect to said handle means.

29. An adjustable mascara applicator according to claim 20, wherein said body has an inner wall extending substantially transverse to said longitudinal direction, said inner wall separating said body into a container securing section and an adjustment section, and said inner wall including an opening therein for receiving said proximal end of said first comb section into said adjustment section.

30. An adjustable mascara applicator according to claim 29, wherein said second comb section is fixedly connected to said inner wall.

31. An adjustable mascara applicator according to claim 20, wherein said first comb section includes at least one slot therein extending in said longitudinal direction thereof and said second comb means includes at least one pin positioned within said at least one slot for limiting movement of said first comb section with respect to said second comb section in said longitudinal direction thereof.

32. An adjustable mascara applicator according to claim 20, wherein the teeth in each of said first and second sets of teeth decrease in height from said proximal end to said distal end of said first and second comb sections.

33. An adjustable mascara applicator according to claim 20, wherein said second comb section includes a central hub and said second set of teeth include a plurality of teeth extending substantially radially outward from opposite sides of said hub with a predetermined angular relation between said teeth on opposite sides of said hub, and said hub includes a longitudinal groove extending therealong; and said first comb section includes a projection slidably positioned for movement within said groove and said first set of teeth includes a plurality of teeth extending from opposite sides of said projection with said predetermined angular relation between teeth of said first set such that teeth of said first and second sets can be adjusted to provide a variable spacing therebetween.

34. An adjustable mascara applicator according to claim 33, wherein said teeth of said first and second sets are arranged in at least a part-circular arrangement.

35. An adjustable mascara applicator according to claim 34, wherein said predetermined angular relation is approximately 120 degrees.

36. An adjustable mascara applicator according to claim 33, wherein said second comb section includes diametrically opposite additional teeth with a predetermined pitch therebetween extending from said hub and said teeth of said first set extend from said hub at an angle to said diametrically opposite additional teeth so as to form a V-shape therebetween.

* * * * *